US011342703B2

(12) United States Patent
Shinoda

(10) Patent No.: US 11,342,703 B2
(45) Date of Patent: May 24, 2022

(54) CONNECTOR

(71) Applicant: SUMITOMO WIRING SYSTEMS, LTD., Mie (JP)

(72) Inventor: Koji Shinoda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/260,666

(22) PCT Filed: Jul. 19, 2019

(86) PCT No.: PCT/JP2019/028546

§ 371 (c)(1),
(2) Date: Jan. 15, 2021

(87) PCT Pub. No.: WO2020/022230

PCT Pub. Date: Jan. 30, 2020

(65) Prior Publication Data

US 2021/0265761 A1 Aug. 26, 2021

(30) Foreign Application Priority Data

Jul. 27, 2018 (JP) ..... JP2018-141567

(51) Int. Cl.
*H01R 13/405* (2006.01)
*H01R 43/24* (2006.01)
*H01R 13/508* (2006.01)

(52) U.S. Cl.
CPC ..... *H01R 13/405* (2013.01); *H01R 13/508* (2013.01); *H01R 43/24* (2013.01)

(58) Field of Classification Search
CPC .. H01R 13/405; H01R 13/424; H01R 13/422; H01R 13/508; H01R 13/5216; H01R 43/24
See application file for complete search history.

(56) References Cited

U.S. PATENT DOCUMENTS 6,902,417 B2 * 6/2005 Maegawa ..... H01R 43/24 439/246
11,217,929 B2 * 1/2022 Yamada ..... H01R 13/405
(Continued)

FOREIGN PATENT DOCUMENTS

JP S62-202790 U 12/1987
JP 2012-099274 A 5/2012
(Continued)

OTHER PUBLICATIONS

International Search Report dated Sep. 3, 2019 for WO 2020/022230 A1 (4 pages).

*Primary Examiner* — Edwin A. Leon
*Assistant Examiner* — Milagros Jeancharles
(74) *Attorney, Agent, or Firm* — Abelman, Frayne & Schwab

(57) ABSTRACT

In a connector (1), one end parts (31A, 31B and 31C) of first terminals (3A), a plurality of second terminals (3B) and a plurality of third terminals (3C) are arranged in parallel to each other along a first direction (D1). An outer resin portion (4) is formed with a first clamping portion (42A) for clamping one end part (20A) of a first core resin portion (2A) and one end part (20B) of a second core resin portion (2B) together, a second clamping portion (42B) for clamping the one end part (20A) of a first core resin portion (2A) and one end part (20C) of a third core resin portion (2C) together and a third clamping portion (42C) for clamping the one end part (20B) of a second core resin portion (2B) and the one end part (20C) of the third core resin portion (2C) together.

10 Claims, 8 Drawing Sheets

(56) References Cited

U.S. PATENT DOCUMENTS

| | | | | |
|---|---|---|---|---|
| 2004/0002260 | A1* | 1/2004 | Okamoto | H01R 43/24 439/606 |
| 2019/0036415 | A1* | 1/2019 | Kataoka | H05K 5/0069 |
| 2020/0106206 | A1* | 4/2020 | Shinoda | H01R 13/514 |
| 2020/0185858 | A1* | 6/2020 | Yamada | H01R 13/405 |
| 2020/0266598 | A1* | 8/2020 | Ito | H01R 43/18 |
| 2020/0350723 | A1* | 11/2020 | Yamada | H01R 31/06 |
| 2020/0391413 | A1* | 12/2020 | Yamada | B29C 33/14 |

FOREIGN PATENT DOCUMENTS

| | | | |
|---|---|---|---|
| JP | 2014-175147 | A | 9/2014 |
| JP | 2016-154072 | A | 8/2016 |

* cited by examiner

CONNECTOR

CROSS REFERENCE TO RELATED APPLICATIONS

This application is a national phase of PCT application No. PCT/JP2019/028546, filed on 19 Jul. 2019, which claims priority from Japanese patent application No. 2018-141567, filed on 27 Jul. 2018, all of which are incorporated herein by reference.

TECHNICAL FIELD

The present disclosure relates to a connector including a plurality of core resin portions having terminals arranged therein and an outer resin portion covering the plurality of core resin portions.

BACKGROUND

A connector is used in electrically wiring various control components to a control device. The connector includes a plurality of terminals to be electrically connected. If the plurality of terminals are arranged in a plurality of stages, insert molding may be performed in a stepwise manner to facilitate an array of the terminals when a resin material is insert-molded. In this case, a plurality of core resin portions in which the terminals in the respective stages are separately arranged are respectively insert-molded as primary molding. Subsequently, the outer resin portion in which the plurality of core resin portions are arranged is insert-molded as secondary molding. In this way, the connector in which the plurality of core resin portions are arranged in the outer resin portion is molded. Such a connector is shown, for example, in Patent Document 1.

PRIOR ART DOCUMENT

Patent Document

Patent Document 1: JP 2016-154072A

SUMMARY OF THE INVENTION

Problems to be Solved

In a part of the connector where end parts of the terminals are arranged, an end part of a resin portion having the terminals arranged therein is provided to project from a body portion of the resin portion. To facilitate the molding of the end part of the resin portion, it is thought to form the end part of the resin portion by the plurality of core resin portions and expose parts of the plurality of core resin portions constituting the end part of the resin portion on a surface of the connector without covering these parts by the outer resin portion.

However, in this case, after the outer resin portion is insert-molded in a mold having the core resin portions arranged therein and a molded article is taken out from the mold, there is nothing to restrain one end parts of the plurality of core resin portions. Thus, when the resin material constituting the outer resin portion is cooled to contract, a stress may act on the one end parts of the plurality of core resin portions in such a direction that the one end parts of the plurality of core resin portions separate from each other. At this time, the positions of the one end parts of the plurality of terminals projecting from the one end parts of the plurality of core resin portions may vary and a trouble may occur in the electrical connection of the plurality of terminals.

The present disclosure was developed in view of such a problem and aims to provide a connector capable of preventing a variation in the position of one end part of each terminal projecting from one end part of each core resin portion even if the one end parts of the plurality of core resin portions are arranged outside an outer resin portion while overlapping each other.

Means to Solve the Problem

One aspect of the present disclosure is directed to a connector with a first terminal, a first core resin portion covering an intermediate part of the first terminal except both end parts, a second terminal, a second core resin portion covering an intermediate part of the second terminal except both end parts, and an outer resin portion partially covering the first and second core resin portions overlapping each other, wherein one end part of the first terminal and one end part of the second terminal are arranged in parallel to each other along a first direction, one end part of the first core resin portion from which the one end part of the first terminal projects and one end part of the second core resin portion from which the one end part of the second terminal projects are facing each other on a boundary surface in a second direction perpendicular to the first direction, and arranged outside the outer resin portion, the outer resin portion is formed with a clamping portion for clamping a part of the one end part of the first core resin portion and a part of the one end part of the second core resin portion together, and the clamping portion includes a first embedded portion extending toward a tip side in the first direction and at least partially embedded at a position of the one end part of the first core resin portion except the boundary surface and a second embedded portion extending toward the tip side in the first direction and at least partially embedded at a position of the one end part of the second core resin portion except the boundary surface.

Effect of the Invention

The connector of the above one aspect is designed to prevent the one end parts of a plurality of the core resin portions from being separated from each other when the one end parts of the plurality of core resin portions are arranged outside the outer resin portion while overlapping each other.

Specifically, the first and second embedded portions of the clamping portion clamp the part of the one end part of the first core resin portion and the part of the second core resin portion facing each other in the second direction from opposite sides in the second direction. In this way, even if a stress when a resin material for constituting the outer resin portion is cooled to contract acts on the one end part of each core resin portion outside a mold in molding the outer resin portion with the respective core resin portions inserted, the one end part of the first core resin portion and the one end part of the second core resin portion can be prevented from being separated away from each other along the second direction by being clamped by the clamping portion.

As just described, in the connector of the above one aspect, when the outer resin portion is molded with the respective core resin portions inserted, a variation in the position of the one end part of each terminal can be prevented by preventing the one end part of each core resin portion arranged outside the outer resin portion from being separated from each other.

Therefore, according to the connector of the above one aspect, even if the one end parts of the plurality of core resin portions are arranged outside the outer resin portion while overlapping each other, a variation in the position of the one end part of each terminal projecting from the one end part of each core resin portion can be prevented.

DETAILED DESCRIPTION TO EXECUTE THE INVENTION

Preferred embodiments of the connector described above are described with reference to the drawings.

First Embodiment

A connector 1 of this embodiment includes, as shown in FIGS. 1 to 4, a plurality of first terminals 3A, a first core resin portion 2A, a plurality of second terminals 3B, a second core resin portion 2B, a plurality of third terminals 3C, a third core resin portion 2C and an outer resin portion 4. The first core resin portion 2A covers intermediate parts 33 of the plurality of first terminals 3A except both end parts 31A, 32A. The second core resin portion 2B covers intermediate parts 33 of the plurality of second terminals 3B except both end parts 31B, 32B. The third core resin portion 2C covers intermediate parts 33 of the plurality of third terminals 3C except both end parts 31C, 32C. The outer resin portion 4 partially covers the first, second and third core resin portions 2A, 2B and 2C overlapping each other.

Figure 5:
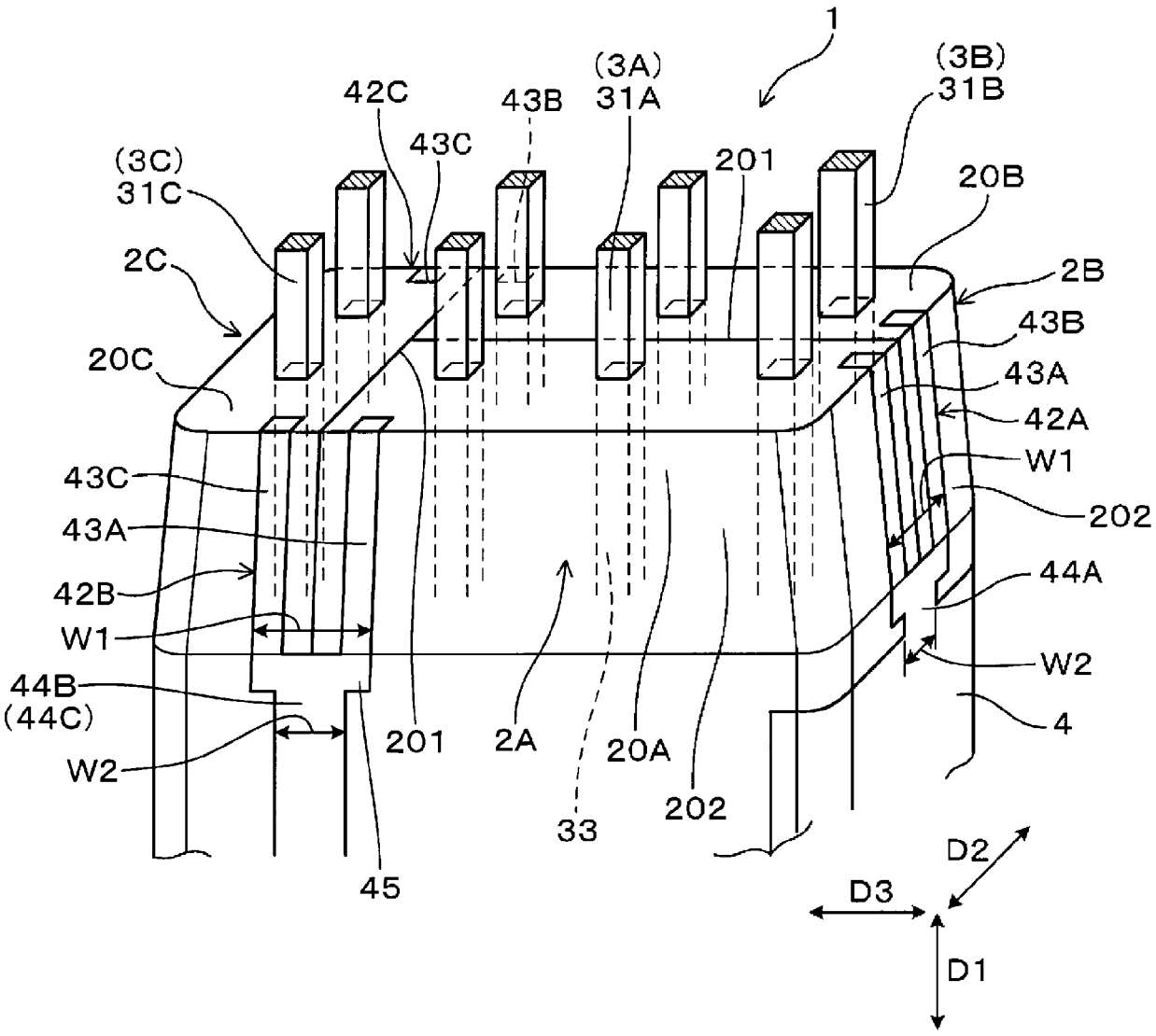
FIG. 5 is a perspective view showing the vicinity of one end parts of first to third core resin portions, in which clamping portions of an outer resin portion are arranged, in the connector according to the first embodiment.
Figure 6:
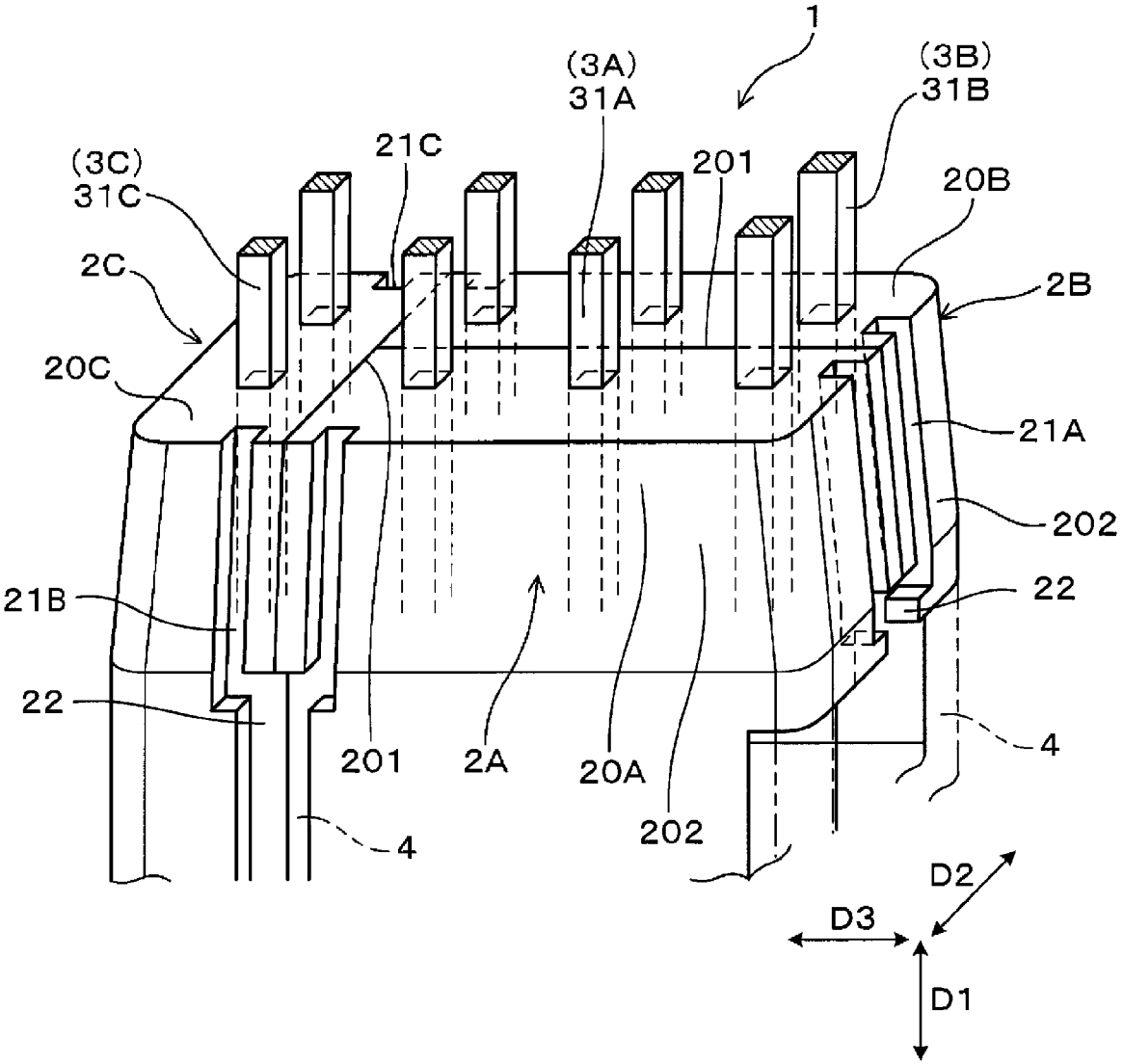
FIG. 6 is a perspective view showing the vicinity of the one end parts of the first to third core resin portions, before the respective clamping portions of the outer resin portion are arranged, in the connector according to the first embodiment.

As shown in FIGS. 5 and 6, one end parts 31A of the plurality of first terminals 3A, one end parts 31B of the plurality of second terminals 3B and one end parts 31C of the plurality of third terminals 3C are arranged in parallel to each other along a first direction D1. One end part 20A of the first core resin portion 2A from which the one end parts 31A of the first terminals 3A project and one end part 20B of the second core resin portion 2B from which the one end parts 31B of the second terminals 3B project are facing each other on a boundary surface 201 in a second direction D2 perpendicular to the first direction D1.

One end part 20C of the third core resin portion 2C from which one end parts 31C of the third terminals 3C project is facing the one end part 20A of the first core resin portion 2A and the one end part 20B of the second core resin portion 2B on a boundary surface 201 in a third direction D3 perpendicular to the first direction D1 and the second direction D2. The one end part 20A of the first core resin portion 2A, the one end part 20B of the second core resin portion 2B and the one end part 20C of the third core resin portion 2C are arranged outside the outer resin portion 4.

Figure 7:
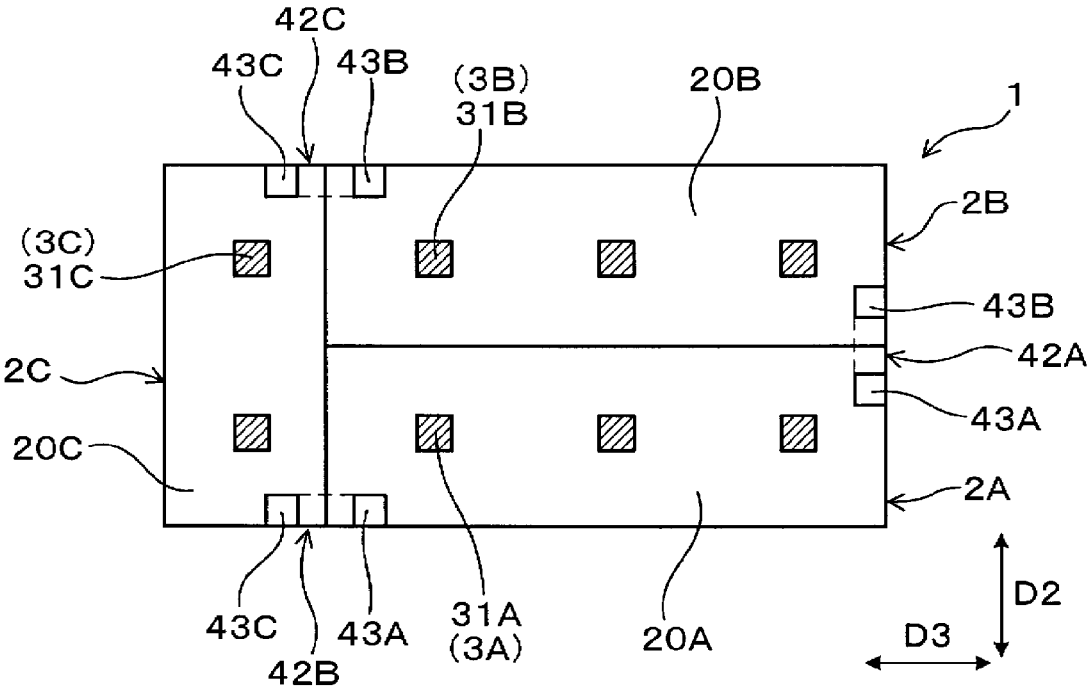
FIG. 7 is a plan view showing the vicinity of the one end parts of the first to third core resin portions, in which the clamping portions of the outer resin portion are arranged, in the connector according to the first embodiment.

As shown in FIGS. 5 and 7, the outer resin portion 4 is formed with a first clamping portion 42A for clamping a part of the one end part 20A of the first core resin portion 2A and a part of the one end part 20B of the second core resin portion 2B together, a second clamping portion 42B for clamping a part of the one end part 20A of the first core resin portion 2A and a part of the one end part 20C of the third core resin portion 2C together, and a third clamping portion 42C for clamping a part of the one end part 20B of the second core resin portion 2B and a part of the one end part 20C of the third core resin portion 2C together.

The first clamping portion 42A includes a first embedded portion 43A partially embedded in the one end part 20A of the first core resin portion 2A and a second embedded portion 43B partially embedded in the one end part 20B of the second core resin portion 2B. The first clamping portion 42A clamps the part of the one end part 20A of the first core resin portion 2A and the part of the one end part 20B of the second core resin portion 2B together by a pair of the first and second embedded portions 43A, 43B.

The second clamping portion 42B includes another first embedded portion 43A partially embedded in the one end part 20A of the first core resin portion 2A and a third embedded portion 43C partially embedded in the one end part 20C of the third core resin portion 2C. The second clamping portion 42B clamps the part of the one end part 20A of the first core resin portion 2A and the part of the one end part 20C of the third core resin portion 2C together by a pair of the first and third embedded portions 43A, 43C.

The third clamping portion 42C includes another second embedded portion 43B partially embedded in the one end part 20B of the second core resin portion 2A and another third embedded portion 43C partially embedded in the one end part 20C of the third core resin portion 2C. The third clamping portion 42C clamps the part of the one end part 20B of the second core resin portion 2B and the part of the one end part 20C of the third core resin portion 2C together by a pair of the second and third embedded portions 43B, 43C.

Two first embedded portions 43A extend toward a tip side of the outer resin portion 4 along the first direction D1 and are partially embedded at positions except at the boundary surface 201 between the one end part 20A of the first core resin portion 2A and the one end part 20B of the second core resin portion 2B and the boundary surface 201 between the one end part 20A of the first core resin portion 2A and the one end part 20C of the third core resin portion 2C. Two second embedded portions 43B extend toward the tip side of the outer resin portion 4 along the first direction D1 and are partially embedded at positions except at the boundary surface 201 between the one end part 20A of the first core resin portion 2A and the one end part 20B of the second core resin portion 2B and the boundary surface 201 between the one end part 20B of the second core resin portion 2B and the one end part 20C of the third core resin portion 2C. Two third embedded portions 43C extend toward the tip side of the outer resin portion 4 along the first direction D1 and are partially embedded at positions except at the boundary surface 201 between the one end part 20A of the first core resin portion 2A and the one end part 20C of the third core resin portion 2C and the boundary surface 201 between the one end part 20B of the second core resin portion 2B and the one end part 20C of the third core resin portion 2C.

The connector 1 of this embodiment is described in detail below.

(Connector 1)

Figure 1:
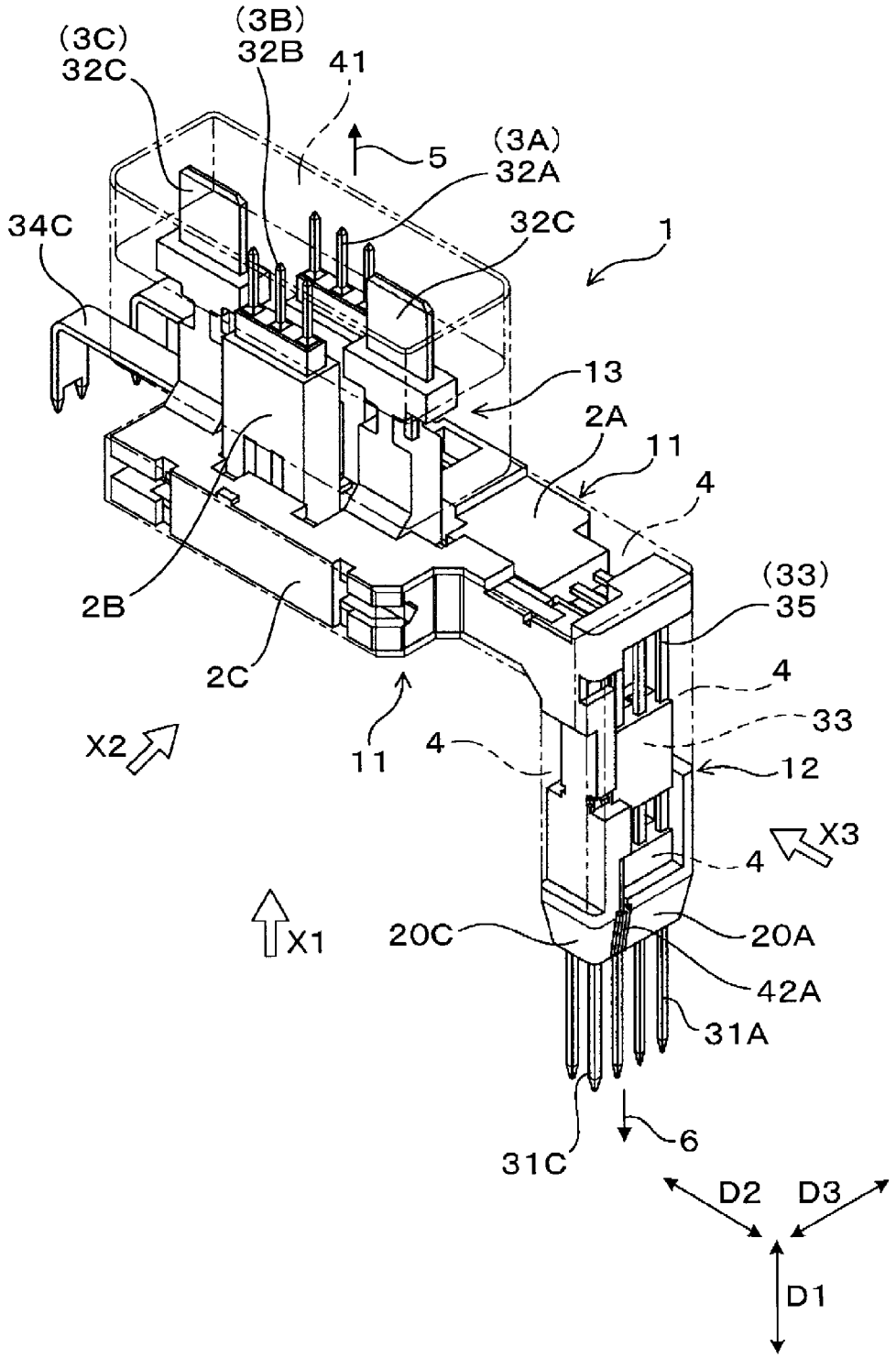
FIG. 1 is a perspective view showing a connector according to a first embodiment.

As shown in FIG. 1, the connector 1 of this embodiment is used as a relay connector for relaying electrical wirings in electrically wiring various control components 5 to a control device. The connector 1 constitutes a male connector provided with the respective terminals 3A, 3B and 3C serving as conductor pins. One end part 31A, 31B, 31C of each terminal 3A, 3B, 3C is connected to a control board 6 of the control device, and the other end part 32A, 32B, 32C of each terminal 3A, 3B, 3C is connected to a female terminal of a female connector.

Figure 2:
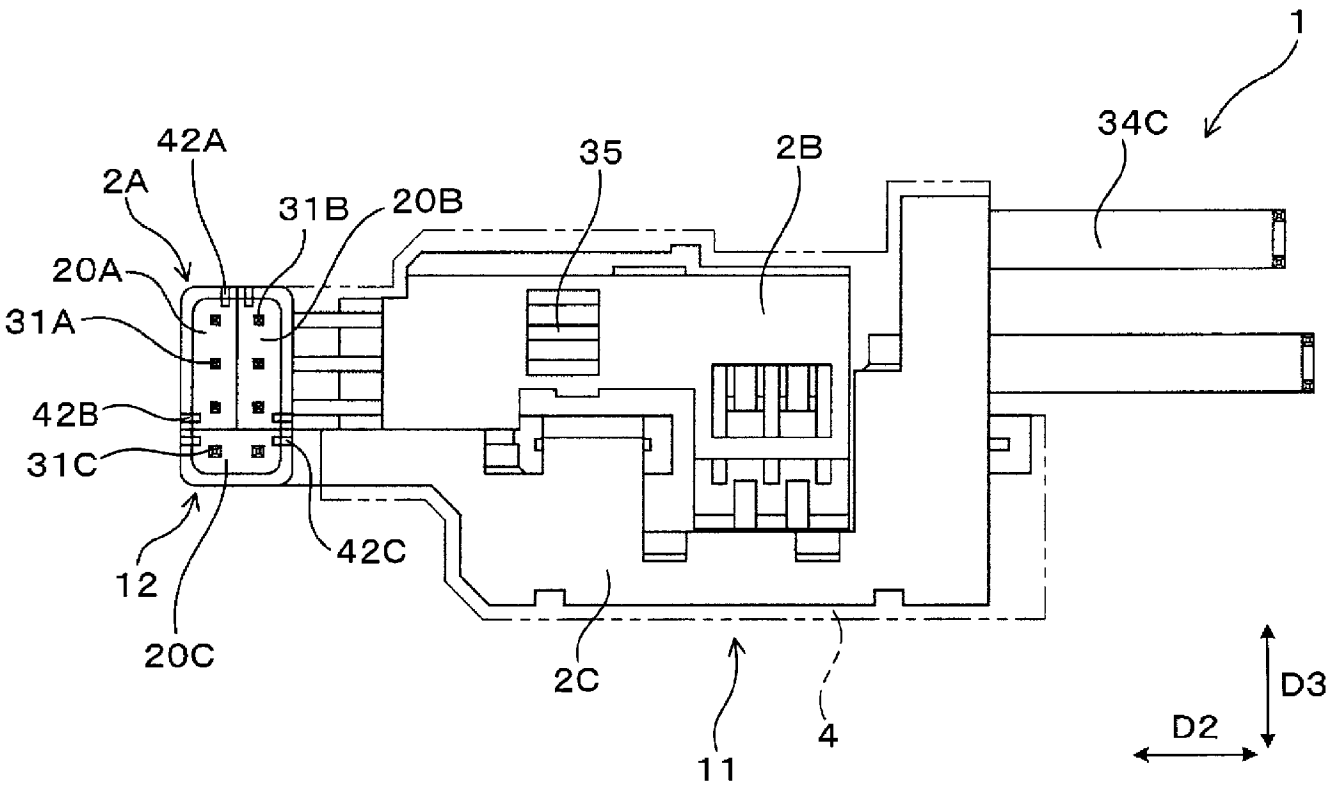
FIG. 2 is a view showing the connector according to the first embodiment viewed in a direction of an arrow X1 of FIG. 1.
Figure 3:
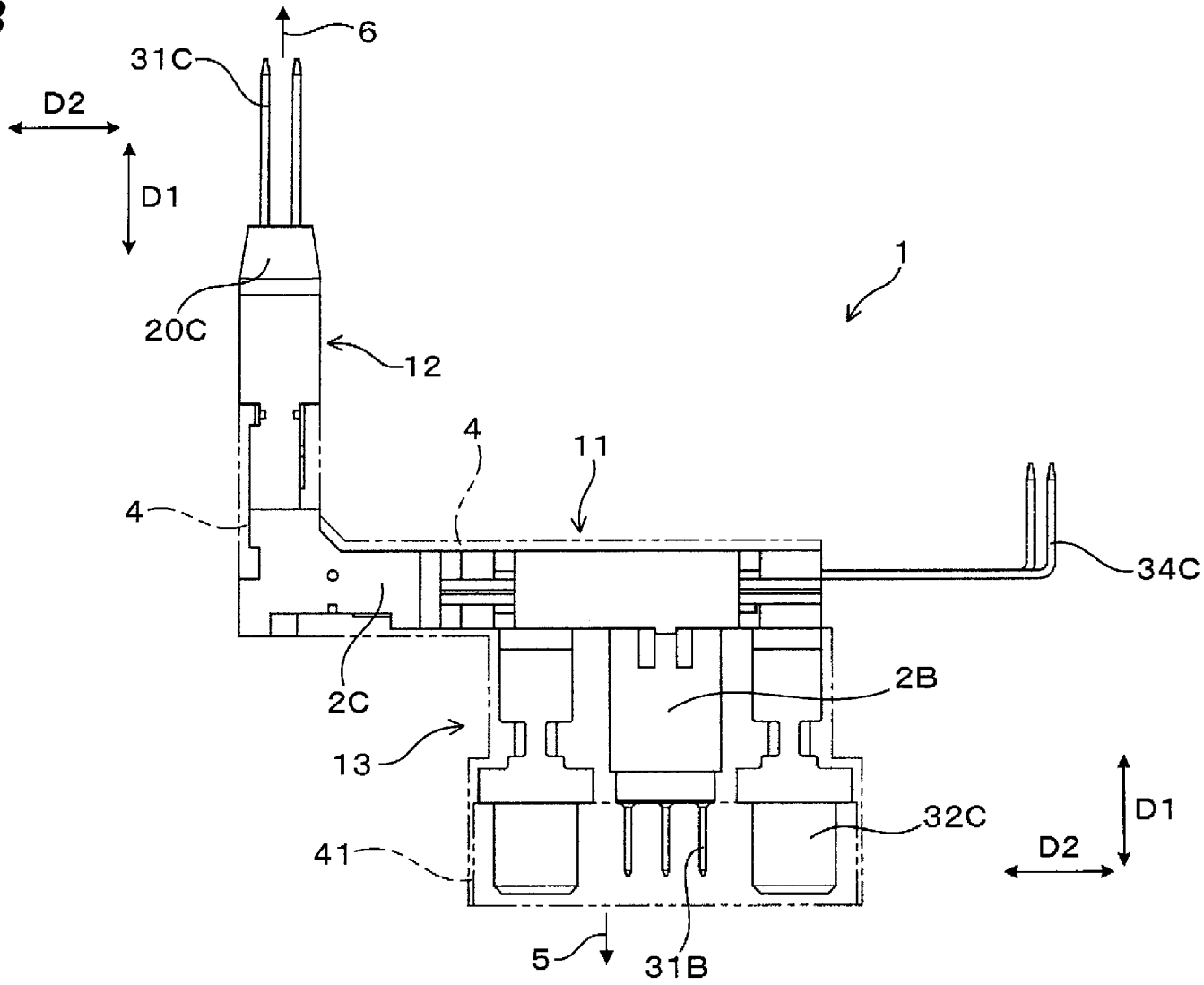
FIG. 3 is a view showing the connector according to the first embodiment viewed in a direction of an arrow X2 of FIG. 1.
Figure 4:
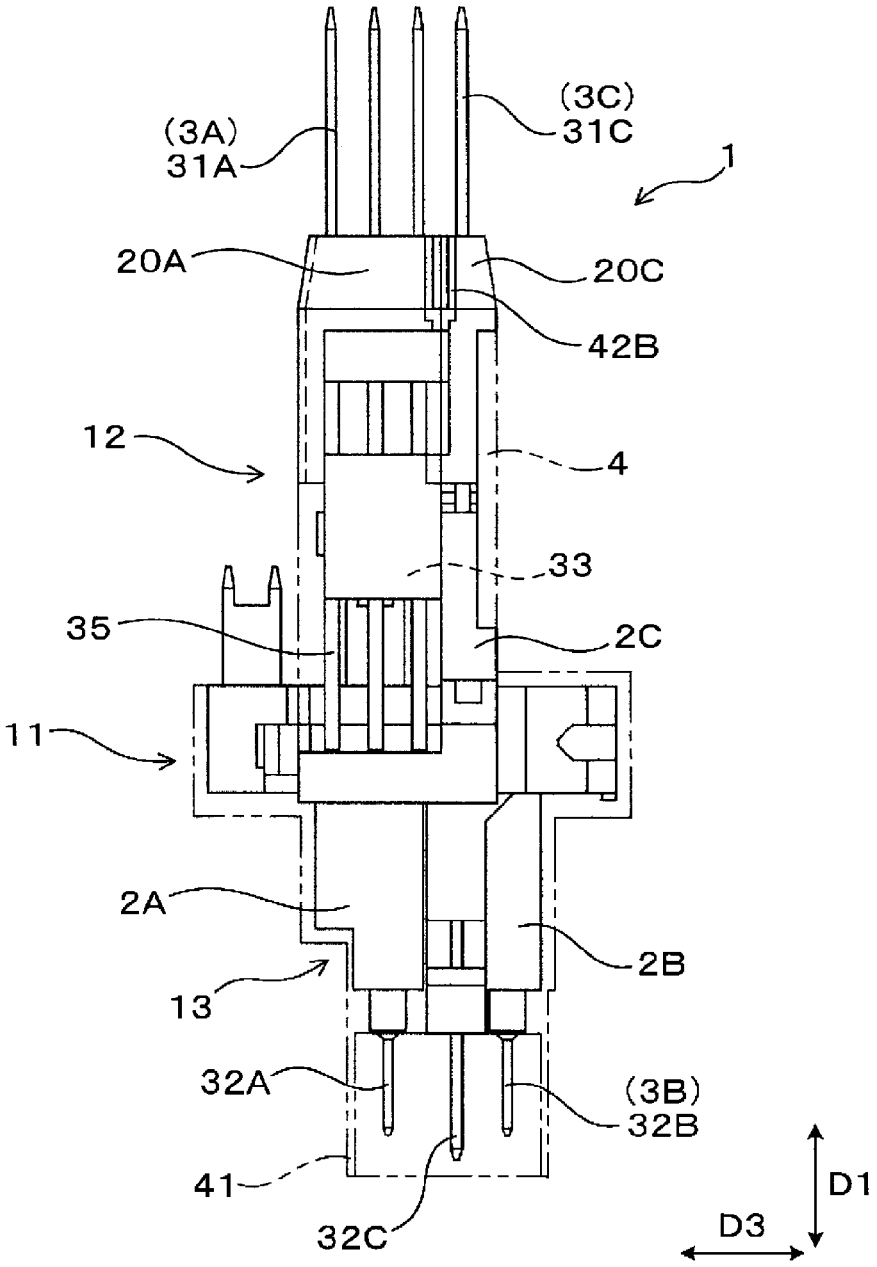
FIG. 4 is a view showing the connector according to the first embodiment viewed in a direction of an arrow X3 of FIG. 1.

As shown in FIGS. 2 to 4, each terminal 3A, 3B, 3C may be used in application either for control or for power supply. The plurality of first terminals 3A and the plurality of second terminals 3B of this embodiment constitute terminals for control and the plurality of third terminals 3C of this embodiment constitute terminals for power supply. The other end parts 32C of the third terminals 3C are connected to other end parts 34C different from the one end parts 31C.

The plurality of first terminals 3A and the plurality of second terminals 3B are arranged to overlap in two stages in the end parts 20A, 20B, 20C and parts of body portions of the respective core resin portions 2A, 2B and 2C. Further, the plurality of third terminals 3C are arranged laterally side by side with the first terminals 3A and the second terminal 3B in the one parts 20A, 20B, 20C and the parts of the body portions of the respective core resin portions 2A, 2B and 2C. Note that the body portions of the respective core resin portions 2A, 2B and 2C mean parts of the respective core resin portions 2A, 2B and 2C except the one end parts 20A, 20B and 20C.

As shown in FIG. 1, the connector 1 of this embodiment includes a connector base portion 11, a connector projecting portion 12 projecting from the connector base portion 11 and a connector mounting portion 13 projecting from the connector base portion 11. The connector base portion 11 constitutes a body portion of the connector 1 arranged to face the control board 6. The connector base portion 11 is a part formed by covering most of the body portion of the first core resin portion 2A, the body portion of the second core resin portion 2B and the body portion of the third core resin portion 2C by the outer resin portion 4.

The connector projecting portion 12 is bent perpendicularly from the connector base portion 11. The connector projecting portion 12 is a part arranged outside the outer resin portion 4 and formed to include the one end part 20A of the first core resin portion 2A, the one end part 20B of the second core resin portion 2B and the one end part 20C of the third core resin portion 2C. The respective core resin portions 2A, 2B and 2C and the outer resin portion 4 are arranged in the connector projecting portion 12. The connector mounting portion 13 is a part formed by covering the other end parts 32A, 32B and 32C of the respective terminals 3A, 3B and 3C by a tubular portion 41 of the outer resin portion 4. The connector mounting portion 13 is mounted on the female connector.

As shown in FIGS. 1 to 4, in the connector projecting portion 12, the outer resin portion 4 is arranged at a position adjacent to base end sides of the one end part 20A of the first core resin portion 2A, the one end part 20B of the second core resin portion 2B and the one end part 20C of the third core resin portion 2C. A surface of the one end part 20A, 20B, 20C of each core resin portion 2A, 2B, 2C is adjacent to a surface of the outer resin portion 4 and forms an outer surface of the connector projecting portion 12. The intermediate parts 33 of the respective terminals 3A, 3B and 3C are formed with exposed portions 35 exposed outside the respective core resin portions 2A, 2B and 2C without being covered by the respective core resin portions 2A, 2B and 2C. The exposed portions 35 are covered by the outer resin portion 4.

Since the outer resin portion 4 is arranged adjacent to the base end side of the one end part 20A, 20B, 20C of each core resin portion 2A, 2B, 2C, a contraction force generated when a resin material for constituting the outer resin portion 4 is molded easily acts on the one end part 20A, 20B, 20C of each core resin portion 2A, 2B, 2C.

As shown in FIGS. 1 and 3, the respective terminals 3A, 3B and 3C are bent and formed into a crank shape in conformity with the shapes of the connector base portion 11, the connector projecting portion 12 and the connector mounting portion 13. The one end part 31A, 31B, 31C of each terminal 3A, 3B, 3C is arranged to project toward one side from the connector base portion 11. The other end part 32A, 32B, 32C of each terminal 3A, 3B, 3C is arranged to project toward the other side from the connector base portion 11.

(Core Resin Portions 2A, 2B, 2C and Outer Resin Portion 4)

As shown in FIG. 1, the respective core resin portions 2A, 2B and 2C are formed by insert molding with the respective terminals 3A, 3B and 3C arranged inside. Further, each of the first to third core resin portions 2A, 2B and 2C is separately molded. The first core resin portion 2A is formed by insert-molding a resin material in a mold with the plurality of first terminals 3A arranged in the mold. The second core resin portion 2B is formed by insert-molding a resin material in a mold with the plurality of second terminals 3B arranged in the mold. The third core resin portion 2C is formed by insert-molding a resin material in a mold with the plurality of third terminals 3C arranged in the mold. In this way, the respective core resin portions 2A, 2B and 2C are formed as primary molded articles with the respective terminals 3A, 3B and 3C inserted.

The connector 1 is formed by insert-molding the resin material for constituting the outer resin portion 4 in a mold with the first to third core resin portions 2A, 2B and 2C arranged in the mold. The outer resin portion 4 is formed as a secondary molded article with the respective core resin portions 2A, 2B and 2C inserted.

(Configurations of One End Parts 31A, 31B, 31C of Terminals 3A, 3B, 3C and One End Parts 20A, 20B, 20C of Core Resin Portions 2A, 2B, 2C)

As shown in FIGS. 1 and 5, the first, second and third directions D1, D2 and D3 are used for convenience to indicate directions in the one end parts 31A, 31B and 31C of the respective terminals 3A, 3B and 3C and the one end parts 20A, 20B and 20C of the respective core resin portions 2A, 2B and 2C. The first direction D1 indicates an extending direction of the one end part 31A, 31B, 31C of each terminal 3A, 3B, 3C and is set as a direction perpendicular to the connector base portion 11 of the connector 1 in which the body portions of the respective terminals 3A, 3B and 3C are arranged. The second and third directions D2, D3 indicate two directions perpendicular to the first direction D1 and are set as directions parallel to the connector base portion 11 of the connector 1. Further, in the first direction D1, a side toward which the one end part 31A, 31B, 31C of each terminal 3A, 3B, 3C projects from each core resin portions 2A, 2B, 2C is referred to as a tip side and a side opposite to the tip side is referred to as a base end side.

As shown in FIGS. 5 to 7, the one end parts 31A of the plurality of first terminals 3A and the one end parts 31B of the plurality of second terminals 3B are respectively aligned and arranged along the third direction D3 while forming one stage. In this embodiment, three first terminals 3A and three second terminals 3B are arranged. The one end parts 31A of the plurality of first terminals 3A and the one end parts 31B of the plurality of second terminals 3B are facing each other in the second direction D2 and arranged to overlap in two stages in the second direction D2.

Further, the one end parts 31C of the plurality of third terminals 3C are adjacent to the one end parts 31A of the first terminals 3A and the one end parts 31B of the second terminals 3B in the third direction D3 and aligned and arranged along the second direction D2. In other words, the one end parts 31C of the plurality of third terminals 3C are arranged side by side with each other in the second direction D2, and also arranged side by side with the first terminals 3A and the second terminals 3B in the third direction D3. In this embodiment, two third terminals 3C are arrayed in conformity with an array of the first terminals 3A and the second terminals 3B overlapping in the two stages.

The one end part 20A of the first core resin portion 2A covering the plurality of first terminals 3A and the one end part 20B of the second core resin portion 2B covering the plurality of second terminals 3B are joined side by side in the second direction D2. Further, the one end part 20C of the third core resin portion 2C covering the plurality of third terminals 3C is joined side by side with the one end part 20A of the first core resin portion 2A and the one end part 20B of the second core resin portion 2B in the third direction D3.

(First to Third Clamping Portions 42A, 42B, 42C)

As shown in FIG. 5, the first clamping portion 42A is arranged on side end surfaces 202 of the one end part 20A of the first core resin portion 2A and the one end part 20B of the second core resin portion 2B on a side opposite to a side where the third core resin portion 2C is arranged in the third direction D3 perpendicular to the first and second directions D1, D2. The first clamping portion 42A is formed to straddle the boundary surface 201 between the one end part 20A of the first core resin portion 2A and the one end part 20B of the second core resin portion 2B.

A first narrow portion 44A having a narrower outer width W2 in the second direction D2 than an outer width W1 in the second direction D1 between outer positions of the respective embedded portions 43A, 43B of the first clamping portion 42A is formed between the outer resin portion 4 and the first clamping portion 42A in the first direction D1. Note that if the respective embedded portions 43A, 43B of the first clamping portion 42A are not formed in parallel to the first direction D1, the outer width W1 can be an outer width between outer positions of base end parts in the first direction D1 of the respective embedded portions 43A, 43B of the first clamping portion 42A. The first and second embedded portions 43A, 43B constituting the first clamping portion 42A are formed to be branched in the second direction D2 from the first narrow portion 44A.

The second clamping portion 42B is arranged on side end surfaces 202 of the one end part 20A of the first core resin portion 2A and the one end part 20C of the third core resin portion 2C on an outer side in the second direction D2. The second clamping portion 42B is formed to straddle the boundary surface 201 between the one end part 20A of the first core resin portion 2A and the one end part 20C of the third core resin portion 2C.

A second narrow portion 44B having a narrower outer width W2 in the third direction D3 than an outer width W1 in the third direction D3 between outer positions of the respective embedded portions 43A, 43C of the second clamping portion 42B is formed between the outer resin portion 4 and the second clamping portion 42B in the first direction D1. Note that if the respective embedded portions 43A, 43C of the second clamping portion 42B are not formed in parallel to the first direction D1, the outer width W1 can be an outer width between outer positions of base end parts in the first direction D1 of the respective embedded portions 43A, 43C of the second clamping portion 42B. The first and third embedded portions 43A, 43C constituting the second clamping portion 42B are formed to be branched in the third direction D3 from the second narrow portion 44B.

The third clamping portion 42C is arranged on side end surfaces 202 of the one end part 20B of the second core resin portion 2B and the one end part 20C of the third core resin portion 2C on an outer side in the second direction D2. The third clamping portion 42C is formed to straddle the boundary surface 201 between the one end part 20B of the second core resin portion 2B and the one end part 20C of the third core resin portion 2C.

A third narrow portion 44C having a narrower outer width W2 in the third direction D3 than an outer width W1 in the third direction D3 between outer positions of the respective embedded portions 43B, 43C of the third clamping portion 42C is formed between the outer resin portion 4 and the third clamping portion 42C in the first direction D1. Note that if the respective embedded portions 43B, 43C of the third clamping portion 42C are not formed in parallel to the first direction D1, the outer width W1 can be an outer width between outer positions of base end parts in the first direction D1 of the respective embedded portions 43B, 43C of the third clamping portion 42C. The second and third embedded portions 43B, 43C constituting the third clamping portion 42C are formed to be branched in the third direction D3 from the third narrow portion 44C.

Since the third narrow portion 44C is formed on a back side of the second narrow portion 44B in FIG. 5, the third narrow portion 44C is shown by parentheses at the position of the second narrow portion 44B for convenience. The outer widths W1, W2 of the third clamping portion 42C and the third narrow portion 44C are set similarly to the outer widths W1, W2 of the second narrow portion 42B and the second narrow portion 44B.

Corner portions 45 formed between the respective narrow portions 44A, 44B and 44C and the respective clamping portions 42A, 42B and 42C in the first direction D1 by forming the respective narrow portions 44A, 44B and 44C are caught by the respective core resin portions 2A, 2B and 2C, whereby it can be made difficult for the respective core resin portions 2A, 2B and 2C to be displaced from each other in the first direction D1.

A cross-sectional area of each narrow portion 44A, 44B, 44C perpendicular to the first direction D1 is preferably larger than a total cross-sectional area of each clamping portion 42A, 42B, 42C perpendicular to the first direction D1. The total cross-sectional area of each clamping portion 42A, 42B, 42C perpendicular to the first direction D1 means a total cross-sectional area of the pair of embedded portions 43A, 43B, 43C of each clamping portion 42A, 42B, 42C perpendicular to the first direction D1. In this case, as shown in FIG. 6, the resin material can easily flow from narrow portion grooves 22 for forming the respective narrow portions 44A, 44B and 44C in the respective core resin portions 2A, 2B and 2C to grooves 21A, 21B and 21C for forming the respective embedded portions 43A, 43B and 43C.

Further, the outer widths W2 of the respective narrow portions 44A, 44B, 44C may be equal to the outer widths W1 of the respective clamping portions 42A, 42B, 42C. Further, the respective clamping portions 42A, 42B and 42C may be directly formed from the outer resin portion 4 without forming the outer resin portion 4 with the respective narrow portions 44A, 44B and 44C.

As shown in FIGS. 5 and 7, in the first to third clamping portions 42A, 42B and 42C, parts embedded in the first core resin portion 2A are referred to as first embedded portions 43A, parts embedded in the second core resin portion 2B are referred to as second embedded portions 43B and parts embedded in the third core resin portion 2C are referred to as third embedded portions 43C. The first to third embedded portions 43A, 43B and 43C of this embodiment are formed in parallel to the first direction D1.

The first to third embedded portions 43A, 43B and 43C may be formed to be oblique to the first direction D1. The first to third embedded portions 43A, 43B and 43C are formed by the resin material for constituting the outer resin portion 4 flowed into the first to third grooves 21A, 21B and 21C. Thus, if the fluidity of the resin material for molding the outer resin portion 4 is ensured during the molding of the outer resin portion 4, the first to third embedded portions 43A, 43B and 43C can be formed into various shapes such as a bent shape and a wavy shape.

The first and second embedded portions 43A, 43B constituting the first clamping portion 42A may be formed into an annular shape by connecting tip parts thereof in the first direction to each other. Further, the first and third embedded portions 43A, 43C constituting the second clamping portion 42B may also be formed into an annular shape by connecting tip parts thereof in the first direction to each other. Further, the second and third embedded portions 43B, 43C constituting the third clamping portion 42C may also be formed into an annular shape by connecting tip parts thereof in the first direction to each other.

As shown in FIGS. 5 and 7, the first to third clamping portions 42A, 42B and 42C are arranged at outer positions of a plane perpendicular to the first direction D1 of the entirety of the one end parts 20A, 20B and 20C of the first to third core resin portions 2A, 2B and 2C when the entirety of the one end parts 20A, 20B and 20C of the first to third core resin portions 2A, 2B and 2C is viewed from the first direction D1. The first to third clamping portions 42A, 42B and 42C are formed to be exposed on the side end surfaces 202 of the first to third core resin portions 2A, 2B and 2C. The side end surfaces 202 mean surfaces of the first to third core resin portions 2A, 2B and 2C located on outer sides in the second and third directions D2, D3. By exposing the first to third clamping portions 42A, 42B and 42C on the side end surfaces 202, the structures of molds for forming the respective grooves 21A, 21B and 21C when the respective core resin portions 2A, 2B and 2C are molded can be simplified.

Further, the pairs of the embedded portions 43A, 43B and 43C constituting the respective clamping portions 42A, 42B and 42C may be embedded inside the respective core resin portions 2A, 2B and 2C other than in the side end surfaces 202 of the respective core resin portions 2A, 2B and 2C. In this case, the respective core resin portions 2A, 2B and 2C are formed with through holes instead of the respective grooves 21A, 21B and 21C.

As shown in FIG. 5, the first embedded portion 43A is formed up to the tip surface in the first direction D1 of the one end part 20A of the first core resin portion 2A. The second embedded portion 43B is formed up to the tip surface in the first direction D1 of the one end part 20B of the second core resin portion 2B. The third embedded portion 43C is formed up to the tip surface in the first direction D1 of the one end part 20C of the third core resin portion 2C. Each embedded portion 43A, 43B, 43C can effectively prevent a displacement of each core resin portion 2A, 2B, 2C in the second and third directions D2, D3 by being formed up to the tip surface in the first direction D1 of the one end part of each core resin portion 2A, 2B, 2C.

However, each embedded portion 43A, 43B, 43C may not be formed up to the tip surface in the first direction D1 of the one end part of each core resin portion 2A, 2B, 2C. In other words, each embedded portions 43A, 43B, 43C may be formed up to the vicinity of the tip surface in the first direction D1 of the one end part of each core resin portion 2A, 2B, 2C.

As shown in FIG. 6, the first core resin portion 2A is formed with the first grooves 21A for arranging the first embedded portions 43A in a state before the connector 1 is formed. The first grooves 21A are formed in the side end surface 202 in the second direction D2 and the side end surface 202 in the third direction D3 of the first core resin portion 2A. Further, the second core resin portion 2B is formed with the second grooves 21B for arranging the second embedded portions 43B in the state before the connector 1 is formed. The second grooves 21B are formed in the side end surface 202 in the second direction D2 and the side end surface 202 in the third direction D3 of the second core resin portion 2B. Further, the third core resin portion 2C is formed with the third grooves 21C for arranging the third embedded portions 43C in the state before the connector 1 is formed. The third grooves 21C are formed in the side end surfaces 202 of the third core resin portion 2C on both sides in the second direction D2. The first to third grooves 21A, 21B and 21C are formed from intermediate parts of the first to third core resin portions 2A, 2B and 2C to be embedded in the outer resin portion 4 to the one end parts 20A, 20B and 20C of the first to third core resin portions 2A, 2B and 2C.

The first to third terminals 3A, 3B and 3C are made of a metal material excellent in conductivity. The first to third core resin portions 2A, 2B and 2C and the outer resin portion 4 are made of thermoplastic resin excellent in moldability such as in injection molding.

(Manufacturing Method)

In manufacturing the connector 1, the first to third core resin portions 2A, 2B and 2C in which the first to third terminals 3A, 3B and 3C are respectively arranged are molded by insert molding. Subsequently, the first to third core resin portions 2A, 2B and 2C are arranged in the mold for molding the connector 1 while being assembled with each other. At this time, the first to third grooves 21A, 21B and 21C of the first to third core resin portions 2A, 2B and 2C are closed by parts of the mold.

Subsequently, the resin material for molding the outer resin portion 4 is injected into the mold. At this time, the resin material for molding the outer resin portion 4 flows into the first to third grooves 21A, 21B and 21C to fill up the first to third grooves 21A, 21B and 21C. In the process of curing the resin material for molding the outer resin portion 4, the molded connector 1 is taken out from the mold.

Subsequently, when the resin material for molding a body portion of the outer resin portion 4 is cooled to contract outside the mold, a force acts on the one end parts 20A, 20B and 20C of the first to third core resin portions 2A, 2B and 2C in a direction to separate the one end parts 20A, 20B and 20C from each other in the second and third directions D2, D3. The body portion of the outer resin portion 4 is a part of the outer resin portion 4 constituting the connector base portion 11 and the connector projecting portion 12 except the first to third clamping portions 42A, 42B and 42C.

At this time, since a volume of the resin material filled into the first to third grooves 21A, 21B and 21C and a cross-sectional area thereof perpendicular to the flow of the resin material are smaller than a volume of the resin material constituting the body portion of the outer resin portion 4 and a cross-sectional area thereof perpendicular to the flow of the resin material, the resin material filled in the first to third grooves 21A, 21B and 21C is thought to be cured earlier than the resin material constituting the body portion of the outer resin portion 4. Thus, when the resin material constituting the body portion of the outer resin portion 4 contracts, the one end parts 20A, 20B and 20C of the first to third core resin portions 2A, 2B and 2C are so supported as not to be separated from each other in the second and third directions D2, D3 by the first to third clamping portions 42A, 42B and 42C formed in the first to third grooves 21A, 21B and 21C. In this way, the resin material constituting the outer resin portion 4 is cured, whereby the connector 1 in which displacements of the one end parts 20A, 20B and 20C of the first to third core resin portions 2A, 2B and 2C are prevented is manufactured.

(Functions and Effects)

The connector 1 of this embodiment is so designed that the one end parts 20A, 20B and 20C of the three core resin portions 2A, 2B and 2C are not separated from each other when being arranged outside the outer resin portion 4 while overlapping each other.

Specifically, the first and second embedded portions 43A, 43B of the first clamping portion 42A of the outer resin portion 4 clamp the part of the one end part 20A of the first core resin portion 2A and the part of the one end part 20B of the second core resin portion 2B facing each other in the second direction D2 from opposite sides in the second direction D2. Further, the first and third embedded portions 43A, 43C of the second clamping portion 42B of the outer resin portion 4 clamp the part of the one end part 20A of the first core resin portion 2A and the part of the one end part 20C of the third core resin portion 2C facing each other in the third direction D3 from opposite sides in the third direction D3. Further, the second and third embedded portions 43B, 43C of the third clamping portion 42C of the outer resin portion 4 clamp the part of the one end part 20B of the second core resin portion 2B and the part of the one end part 20C of the third core resin portion 2C facing each other in the third direction D3 from opposite sides in the third direction D3.

By these configurations, even if a stress when the resin material constituting the body portion of the outer resin portion 4 is cooled to contract outside the mold acts on the one end part 20A, 20B, 20C of each core resin portion 2A, 2B, 2C in molding the outer resin portion 4 with the respective core resin portions 2A, 2B and 2C inserted, the separation of the one end part 20A of the first core resin portion 2A and the one end part 20B of the second core resin portion 2B from each other in the second direction D2 can be prevented. Further, in this case, the separation of the one end part 20A of the first core resin portion 2A and the one end part 20C of the third core resin portion 2C from each other in the third direction D3 can be prevented, and the separation of the one end part 20B of the second core resin portion 2B and the one end part 20C of the third core resin portion 2C from each other in the third direction D3 can be prevented. Particularly, a positional relationship of the one end parts 20A, 20B and 20C of the first to third core resin portions 2A, 2B and 2C in the second and third directions D2, D3 is maintained after the molded connector 1 is taken out from the mold.

As just described, in the connector 1 of this embodiment, when the outer resin portion 4 is molded with the respective core resin portions 2A, 2B and 2C inserted, a variation in the position of the one end part 20A, 20B, 20C of each core resin portion 2A, 2B, 2C can be prevented by preventing the one end part 20A, 20B, 20C of each core resin portion 2A, 2B, 2C arranged outside the outer resin portion 4 from being separated from each other.

Therefore, according to the connector 1 of this embodiment, even if the one end parts 20A, 20B and 20C of the three core resin portions 2A, 2B and 2C are arranged outside the outer resin portion 4 while overlapping each other, a variation in the position of the one end part 31A, 31B, 31C of each terminal 3A, 3B, 3C projecting from the one end part 20A, 20B, 20C of each core resin portions 2A, 2B, 2C can be prevented.

Second Embodiment

Figure 8:
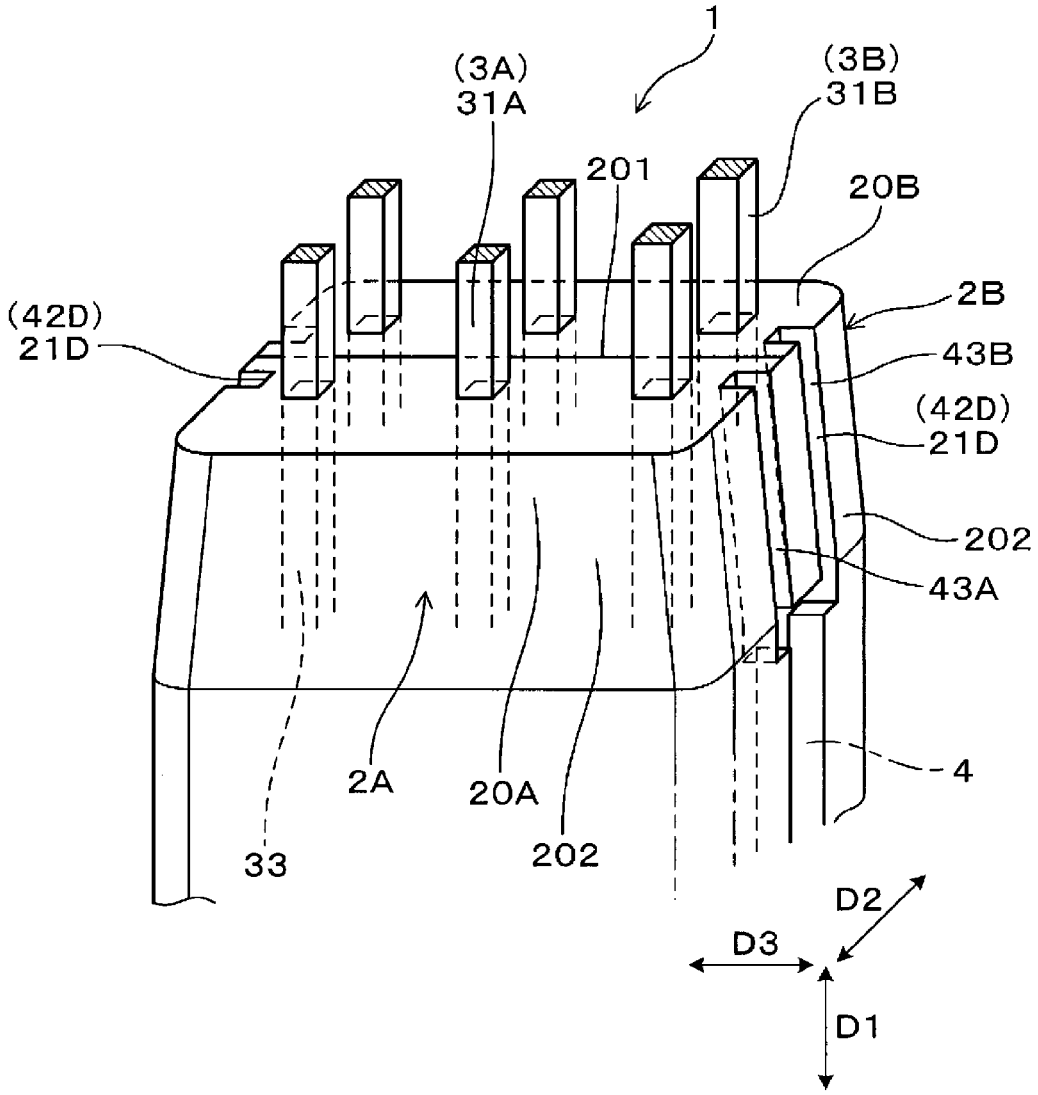
FIG. 8 is a perspective view showing the vicinity of one end parts of first and second core resin portions, before clamping portions of an outer resin portion are arranged, in a connector according to a second embodiment.

A connector 1 including two core resin portions, i.e. a first core resin portion 2A and a second core resin portion 2B, is shown in a second embodiment as shown in FIG. 8. The connector 1 of this embodiment includes a plurality of first terminals 3A, the first core resin portion 2A, a plurality of second terminals 3B, the second core resin portion 2B and an outer resin portion 4. The first core resin portion 2A covers intermediate parts 33 of the plurality of first terminals 3A except both end parts 31A, 32A. The second core resin portion 2B covers intermediate parts 33 of the plurality of second terminals 3B except both end parts 31B, 32B. The outer resin portion 4 partially covers the first and second core resin portions 2A, 2B overlapping each other.

One end parts 31A of the plurality of first terminals 3A and one end parts 31B of the plurality of second terminals 3B are arranged in parallel along a first direction D1. One end part 20A of the first core resin portion 2A from which the one end parts 31A of the first terminals 3A project and one end part 20B of the second core resin portion 2B from which the one end parts 31B of the second terminals 3B project are facing each other on a boundary surface 201 in a second direction D2 perpendicular to the first direction D1.

As shown in FIG. 8, the outer resin portion 4 is formed with clamping portions 42D for clamping a part of the one end part 20A of the first core resin portion 2A and a part of the one end part 20B of the second core resin portion 2B together. The clamping portions 42D are respectively arranged on both end parts in a third direction D3 perpendicular to the first and second directions D1, D2 of the one end part 20A of the first core resin portion 2A and the one end part 20B of the second core resin portion 2B.

The clamping portion 42D includes a first embedded portion 43A partially embedded in the one end part 20A of the first core resin portion 2A and a second embedded portion 43B partially embedded in the one end part 20B of the second core resin portion 2B. The first embedded portion 43A extends toward the tip of the outer resin portion 4 in the first direction D1 and is partially embedded at a position except the boundary surface 201 between the one end part 20A of the first core resin portion 2A and the one end part 20B of the second core resin portion 2B. The second embedded portion 43B extends toward the tip of the outer resin portion 4 in the first direction D1 and is partially embedded at a position except the boundary surface 201 between the one end part 20A of the first core resin portion 2A and the one end part 20B of the second core resin portion 2B.

The clamping portion 42D of this embodiment includes the first embedded portion 43A and the second embedded portion 43B similarly to the first clamping portion 43A of the first embodiment. Grooves 21D into which the clamping portions 42D are arranged are configured similarly to the respective grooves 21A, 21B of the first embodiment. The first and second core resin portions 2A, 2B and the first and second terminals 3A, 3B of this embodiment are configured similarly to the first and second core resin portions 2A, 2B and the first and second terminals 3A, 3B of the first embodiment.

In the connector 1 of this embodiment, when the outer resin portion 4 is molded with the first and second core resin portions 2A, 2B inserted, a variation in the positions of the one end parts 31A, 31B of the first and second terminals 3A, 3B can be prevented by preventing the one end parts 20A, 20B of the first and second core resin portions 2A, 2B arranged outside the outer resin portion 4 from being separated from each other.

Therefore, according to the connector 1 of this embodiment, even if the one end parts 20A, 20B of the two core resin portions 2A, 2B are arranged outside the outer resin portion 4 while overlapping each other, a variation in the position of the one end part 31A, 31B of each terminal 3A, 3B projecting from the one end part 20A, 20B of each core resin portion 2A, 2B can be prevented.

The other configuration, functions, effects and the like of the connector 1 of this embodiment are similar to those of the first embodiment. Further, also in this embodiment, constituent elements denoted by the same reference signs as those shown in the first embodiment are similar to those in the case of the first embodiment.

The present invention is not limited only to the respective embodiments and further different embodiments can be configured without departing from the gist of the present invention. Further, the present invention includes various modifications, modifications within the scope of equivalents and the like.

What is claimed is:

1. A connector, comprising:

a first terminal;

a first core resin portion covering an intermediate part of the first terminal except both end parts;

a second terminal;

a second core resin portion covering an intermediate part of the second terminal except both end parts; and an outer resin portion partially covering the first and second core resin portions overlapping each other, wherein:

one end part of the first terminal and one end part of the second terminal are arranged in parallel to each other along a first direction, one end part of the first core resin portion from which the one end part of the first terminal projects and one end part of the second core resin portion from which the one end part of the second terminal projects are facing each other on a boundary surface in a second direction perpendicular to the first direction, and arranged outside the outer resin portion, the outer resin portion is formed with a clamping portion for clamping a part of the one end part of the first core resin portion and a part of the one end part of the second core resin portion together, and the clamping portion includes a first embedded portion extending toward a tip side in the first direction and at least partially embedded at a position of the one end part of the first core resin portion except the boundary surface and a second embedded portion extending toward the tip side in the first direction and at least partially embedded at a position of the one end part of the second core resin portion except the boundary surface.

2. The connector of claim 1, wherein the clamping portion is arranged at each of both end parts in a third direction perpendicular to the first direction and the second direction of the one end part of the first core resin portion and the one end part of the second core resin portion.

3. The connector according to claim 1, wherein:

the first embedded portion is formed up to a tip surface in the first direction of the one end part of the first core resin portion, and the second embedded portion is formed up to a tip surface in the first direction of the one end part of the second core resin portion.

4. The connector according to claim 1, wherein:

a narrow portion having a narrower outer width in the second direction than an outer width in the second direction of the clamping portion is formed between the outer resin portion and the clamping portion in the first direction, and the first and second embedded portions are formed to be branched from the narrow portion.

5. The connector according to claim 1, wherein one end parts of a plurality of the first terminals and one end parts of a plurality of the second terminals are aligned and arranged along a third direction perpendicular to the first direction and the second direction.

6. The connector according to claim 1, further comprising:

a third terminal; and a third core resin portion covering an intermediate part of the third terminal except both end parts, wherein:

the outer resin portion partially covers the first core resin portion, the second core resin portion and the third core resin portion overlapping each other, one end part of the first terminal, one end part of the second terminal and one end part of the third terminal are arranged in parallel to each other along the first direction, one end part of the third core resin portion from which the one end part of the third terminal projects is facing the one end part of the first core resin portion from which the one end part of the first terminal projects and the one end part of the second core resin portion from which the one end part of the second terminal projects on a boundary surface in a third direction perpendicular to the first direction and the second direction, and arranged outside the outer resin portion, and the clamping portion comprises:

a first clamping portion composed of a pair of the first and second embedded portions and configured to clamp a part of the one end part of the first core resin portion and a part of the one end part of the second core resin portion;

a second clamping portion composed of a pair of another first embedded portion and a third embedded portion extending toward the tip side in the first direction of the outer resin portion and embedded at a position including a side end surface except the boundary surface or at an inner position in the one end part of the second core resin portion and configured to clamp a part of the one end part of the first core resin portion and a part of the one end part of the third core resin portion; and a third clamping portion composed of a pair of another second embedded portion and another third embedded portion and configured to clamp a part of the one end part of the second core resin portion and a part of the one end part of the third core resin portion.

7. The connector according to claim 6, wherein:

the first clamping portion is arranged on a side end surface in the third direction located on a side opposite to a boundary surface between the one end parts of the first and second core resin portions and the one end part of the third core resin portion to straddle the one end part of the first core resin portion and the one end part of the second core resin portion, the second clamping portion is arranged on a side end surface in the second direction to straddle the one end part of the first core resin portion and the one end part of the third core resin portion, and the third clamping portion is arranged on a side end surface in the second direction to straddle the one end part of the second core resin portion and the one end part of the third core resin portion.

8. The connector according to claim 6, wherein:

the first embedded portion is formed up to a tip surface in the first direction of the one end part of the first core resin portion, the second embedded portion is formed up to a tip surface in the first direction of the one end part of the second core resin portion, and the third embedded portion is formed up to a tip surface in the first direction of the one end part of the third core resin portion.

9. The connector according to claim 6, wherein:

a first narrow portion having a narrower outer width in the second direction than an outer width in the second direction of the first clamping portion is formed between the outer resin portion and the first clamping portion in the first direction, the first and second embedded portions constituting the first clamping portion are formed to be branched from the first narrow portion, a second narrow portion having a narrower outer width in the third direction than an outer width in the third direction of the second clamping portion is formed between the outer resin portion and the second clamping portion in the first direction, the first and third embedded portions constituting the second clamping portion are formed to be branched from the second narrow portion, a third narrow portion having a narrower outer width in the third direction than an outer width in the third direction of the third clamping portion is formed between the outer resin portion and the third clamping portion in the first direction, and the second and third embedded portions constituting the third clamping portion are formed to be branched from the third narrow portion.

10. The connector according to claim 6, wherein:

one end parts of a plurality of the first terminals and one end parts of a plurality of the second terminals are aligned and arranged along the third direction, and one end parts of a plurality of the third terminals are adjacent to the one end parts of the first terminals and the one end parts of the second terminals in the third direction and aligned and arranged along the second direction.

* * * * *